US005237807A

United States Patent [19]

Iwade et al.

[11] Patent Number: 5,237,807

[45] Date of Patent: Aug. 24, 1993

[54] SPINNING MACHINE

[75] Inventors: Takashi Iwade, Kyoto; Hiroyuki Matsumura; Hiroshi Arai, both of Shiga, all of Japan

[73] Assignee: Toray Engineering Co., Ltd., Osaka, Japan

[21] Appl. No.: 893,884

[22] Filed: Jun. 4, 1992

Related U.S. Application Data

[63] Continuation of Ser. No. 591,879, Oct. 2, 1990, abandoned.

[30] Foreign Application Priority Data

Oct. 2, 1989 [JP] Japan ..... 1-258395

[51] Int. Cl.[5] ..... D01H 13/26; D01H 13/16; D01H 9/10; F16D 65/36

[52] U.S. Cl. ..... 57/261; 57/81; 57/264; 57/268; 188/158

[58] Field of Search ..... 57/264, 261, 268, 100, 57/81, 263; 188/161, 159, 158

[56] References Cited

U.S. PATENT DOCUMENTS

| | | | |
|---|---|---|---|
| 3,902,308 | 9/1975 | Bernstein et al. | 57/264 X |
| 4,028,869 | 6/1977 | Schäfer et al. | 57/81 X |
| 4,043,106 | 8/1977 | Stahlecker | 57/81 X |
| 4,425,754 | 1/1984 | Lane | 57/81 X |
| 4,532,759 | 8/1985 | Bischofberger | 57/264 |
| 4,671,577 | 6/1987 | Woods | 188/159 X |
| 4,676,056 | 6/1987 | Nickolay et al. | 57/81 |
| 4,703,617 | 11/1987 | Engeli et al. | 57/264 X |
| 4,799,353 | 1/1989 | Kawasaki et al. | 57/261 X |
| 4,817,381 | 4/1989 | Meissner | 57/261 X |
| 4,821,504 | 4/1989 | Shinkai et al. | 57/264 X |

FOREIGN PATENT DOCUMENTS

| | | | |
|---|---|---|---|
| 0126373 | 11/1984 | European Pat. Off. . | |
| 0310822 | 6/1989 | European Pat. Off. . | |
| 3805662 | 9/1989 | Fed. Rep. of Germany | 57/100 |
| 57-89625 | 6/1982 | Japan . | |
| 57-141365 | 9/1982 | Japan . | |
| 60-47937 | 10/1985 | Japan . | |
| 61-60016 | 12/1986 | Japan . | |
| 61-266622 | 11/1988 | Japan . | |

*Primary Examiner*—Daniel P. Stodola
*Assistant Examiner*—Michael Mansen
*Attorney, Agent, or Firm*—Burns, Doane, Swecker & Mathis

[57] ABSTRACT

A spinning machine including a yarn treating carrier provided with a yarn piecing mechanism and a yarn package doffing mechanism therein, moving along a rail provided on a frame of a spinning machine so as at least to stop at predetermined spindle for carrying out a yarn piecing operation and a yarn package doffing operation, and a detecting unit for detecting a position of the yarn treating carrier at each spindle portion, the yarn treating carrier controlled so as to perform at least one of a moving operation, a decelerating operation, and a stopping operation in response to a yarn treatment signal and a detection signal of a position of the yarn treating carrier, each of which being output from each of the spindles.

4 Claims, 6 Drawing Sheets

Fig. 4

| SP-No | 1 | 2 | 3 | 4 | 5 | 6 | ---------- | 58 | 59 | 60 |
|---|---|---|---|---|---|---|---|---|---|---|
| YARN BREAKAGE | 0 | 1 | 1 | 0 | 0 | 1 | | 1 | 0 | 0 |
| YARN PIECING REQUIREMENT | 0 | 1 | 0 | 0 | 0 | 0 | | 0 | 0 | 0 |
| YARN PACKAGE DOFFING REQUIREMENT | 0 | 0 | 0 | 0 | 0 | 1 | | 0 | 0 | 0 |
| YARN TREATING CARRIER DETECTING DEVICE | 0 | 0 | 0 | 1 | 0 | 0 | | 0 | 0 | 0 |
| FULL BOBBIN | 0 | 0 | 0 | 0 | 0 | 1 | | 0 | 0 | 0 |

0 : UNACTUATED (NO TREATING OPERATION IS REQUIRED)

1 : ACTUATED (YARN TREATING OPERATION IS REQUIRED)

SPINNING MACHINE

This application is a continuation of application Ser. No. 07/591,879, filed Oct. 2, 1990, now abandoned.

BACKGROUND OF THE INVENTION

1. Field of the Invention

This invention relates to a spinning machine having a yarn treating carrier provided with a yarn piecing mechanism and a yarn package doffing mechanism therein and moving along a rail provided on a frame of a spinning machine so as at least to stop at a predetermined spindle for carrying out a yarn piecing operation to the spindle and a yarn package doffing operation.

2. Description of the Related Art

Generally, a spinning machine is provided with a yarn forming and winding device, as unit spindle, including at least a yarn drafting mechanism, a yarn forming mechanism, a yarn detecting mechanism, and a yarn winding mechanism. A plurality of these unit spindles, i.e., the yarn forming and winding devices, are arranged along a longitudinal direction of a frame of the machine with a certain distance interposed therebetween to form a spinning machine.

A spinning machine is further provided with a yarn treating carrier including a yarn piecing mechanism and a yarn package doffing mechanism therein. This which moves along a rail provided on a frame of a spinning machine so as at least to stop at a predetermined spindle for carrying out a yarn piecing operation to the spindle and a yarn package doffing operation thereof.

In one aspect of a conventional spinning machine, a yarn treating carrier including a yarn piecing mechanism and a yarn package doffing mechanism is controlled to move to a predetermined position and to stop thereat by detecting a dog provided at a predetermined position on the yarn forming and winding device utilizing an encoder which can discriminate an absolute position of the dog and which is provided on the yarn treating carrier.

The moving system of the yarn treating carrier as mentioned above is, for example, disclosed in Japanese Unexamined Patent Publication No. 61-266622.

The system explained above, however, requires the same number of dogs, each having a different pattern, as the number of the spindles in the yarn forming and winding device.

Further, the system, in order to detect a pattern of a dog when the yarn treating carrier moves along the rail, requires a dog having a significantly elongated portion in a moving direction. Moreover, when the number of dogs is increased, a problem arises in that the number of bit of a dog to be detected will be increased, resulting a broader width of the dog.

On the other hand, in this system, when a moving direction of the yarn treating carrier is determined, it is required to input not only information about a current position at which the yarn treating carrier is exists but also information about a yarn treatment requirement to a moving direction indicating circuit.

Thus, when the moving direction indicating circuit is provided on the yarn treating carrier, it is necessary to transmit information requiring the yarn treatment of each spindle from a machine frame side to the yarn treating carrier while when the moving direction indicating circuit is provided on the machine frame side, it is necessary to transmit the information about a current position at which the yarn treating carrier exists from the carrier to the machine frame as well as to transmit the moving direction indicating signal from the machine frame to the carrier.

In any case, since the number of signals is increased, and the number of wirings for transmitting the above signals between the carrier and the machine frame and the number of connecting portions for connecting the wirings are increased, another problem arises in that the reliability of the machine will be reduced.

On the other hand, in order to transmit these signals to a predetermined position accurately, expensive transmitting terminals should be used.

In another conventional spinning machine, the yarn treating carrier is controlled in such a way that when the yarn treating carrier detects a spindle at which a yarn treatment operation, is required, it stops at the spindle and carries out a predetermined yarn treating operation.

After the yarn treating operation has finished, the yarn treating carrier selects a moving direction to which it moves next.

The moving system of the yarn treating carrier as explained above, is disclosed in, for example, Japanese Examined Patent Publication No. 60-47937 and Japanese Examined Patent Publication No. 61-60016.

In this system, however, a problem arises in that since an occasion in which an operational pattern, for example, a moving direction of the yarn treating carrier, can be changed occurs only when the yarn treating carrier stops at one end of the machine frame or at the time when the carrier starts to move after the yarn treating operation has finished at the spindle to which the yarn treatment was required, immediate yarn treatment cannot be expected at a spindle at which the yarn treatment requirement occurs while the yarn treating carrier is moving along the rail.

In still another conventional spinning machine, the yarn treatment requiring signal is output and indicated at each spindle respectively and, therefore, when the yarn treating carrier detects a spindle at which a yarn treatment operation is required, it shops at the spindle and carries out a predetermined yarn treating operation.

The moving system of the yarn treating carrier as explained above is disclosed in, for example, Japanese Unexamined Patent Publication No. 60-47937.

In this system as mentioned above, the yarn treating carrier successively moves to the spindles adjacently arranged and when it detects the spindle to be treated it stops thereat to perform the necessary yarn treatment.

This system, however, has another problem in that it is difficult to make the starting position of the yarn treating carrier deceleration longer than a pitch P formed between the adjacently arranged spindles.

Note that when the pitch P formed between the adjacently arranged spindles is set at 230 mm, the distance for deceleration of the yarn treating carrier is from 100 mm to 130 mm, since a distance is required for acceleration at the start of movement.

If, when the distance for deceleration is set at more than 130 mm, it is difficult to increase the maximum speed since there is no distance for acceleration resulting a starting operation beginning with a decelerating operation.

Therefore, when a spinning machine starts a yarn forming operation and a yarn treating carrier also moves from one spindle to the next spindle and stops in sequence, since the yarn treating carrier starts to be decelerated before it is sufficiently accelerated, it is apparent that the yarn treating carrier always moves at a low speed and thus a problem arises in that the response time for yarn treating operation to the spindle at which a yarn treatment is required is usually prolonged and the operational efficiency is extremely low.

On the other hand, since a moving direction of the yarn treating carrier cannot be reversed except when it takes a position at one of the ends of the machine frame, when a yarn treatment operation is just required at a spindle located in an opposite direction to a direction in which the yarn treating carrier is now moving, a problem arises in that the waiting time for the yarn treatment will be prolonged.

In another conventional spinning machine, a yarn treating carrier carries out a yarn piecing operation only in response to a yarn treatment signal output from a spindle, the amount of yarn wound of a yarn package, i.e., a diameter of a yarn package, of each spindle is different from that of another spindle since the amount of the yarn wound on the yarn package is determined by the total time of yarn breakage.

In this system, although the yarn winding operation is sequentially stopped for spindles where the yarn package is full, the doffing operation is carried out at the same time in the machine after all of the yarn packages in all spindles are full, or the yarn package doffing operation is carried out when a yarn package of a predetermined spindle in the same machine frame is full.

Accordingly, other problems arise in that, in the former case, the operational efficiency is low, while in the latter case, a variation occurs in the amount of yarn wound on the yarn packages.

SUMMARY OF THE INVENTION

The first object of the present invention is to provide a yarn treatment system in which a detecting device for detecting a yarn treatment signal is commonly used and a position of a yarn treating carrier can be detected precisely and, further, to provide a yarn treating system in which the amount of information to be transmitted between a yarn treating carrier and a machine frame can be reduced.

The second object of the present invention is to provide a yarn treating system in which an operating pattern of the yarn treating carrier, including a moving direction thereof, can be easily changed even if it is moving in one direction.

The third object of the present invention is to provide a yarn treatment in which a speed of the yarn treating carrier can be increased.

The fourth object of the present invention is to provide a yarn treatment system in which difference in weight of each package that is wound now, can be decreased.

To attain these objects, in accordance with the first aspect of the present invention, there is provided a spinning machine having a yarn treating carrier, provided with a yarn piecing mechanism and a yarn package doffing mechanism therein and moving along a rail provided on a frame of the spinning machine so as at least to stop at a predetermined spindle for carrying out a yarn piecing operation and a yarn bobbin doffing operation, and a detecting means for detecting a position of the yarn treating carrier at each spindle portion, the yarn treating carrier controlled so as to perform at least one of a moving operation, a decelerating operation, and a stopping operation in response to a yarn treatment signal and a detection signal of a position of the yarn treating carrier, each of which being output from each of the spindles.

In accordance with a second aspect of the present invention, a starting position at which a speed of the yarn treating carrier is decelerated is varied in response to a current moving speed of the yarn treating carrier with respect to the yarn treatment signal output from each of the spindles, a position at which the yarn treating carrier exists, and a distance by which the yarn treating carrier moves.

Then, in accordance with the third aspect of the present invention, a spinning machine has another technical feature in which the yarn treating carrier is controlled so as to operate the moving, stopping and turning operation in response to a yarn treatment requiring signal, and in accordance with a detection signal the direction of moving of the yarn treating carrier is also controlled.

Further, in accordance with a fourth aspect of the present invention, an amount of yarn wound on a yarn package is counted from the time when a yarn winding operation is started, and the yarn treating carrier is controlled so that the yarn treating carrier is preferentially moved to a spindle with a yarn package with a yarn amount smaller than that of other spindles when a plurality of spindles simultaneously require the yarn treatment operation.

BRIEF DESCRIPTION OF THE DRAWINGS

FIG. 4 is a table indicating each operating signal output from the detecting devices;

DESCRIPTION OF THE PREFERRED EMBODIMENTS

The preferred embodiments of the present invention will be explained with reference to the attached drawings hereunder.

Figure 1:
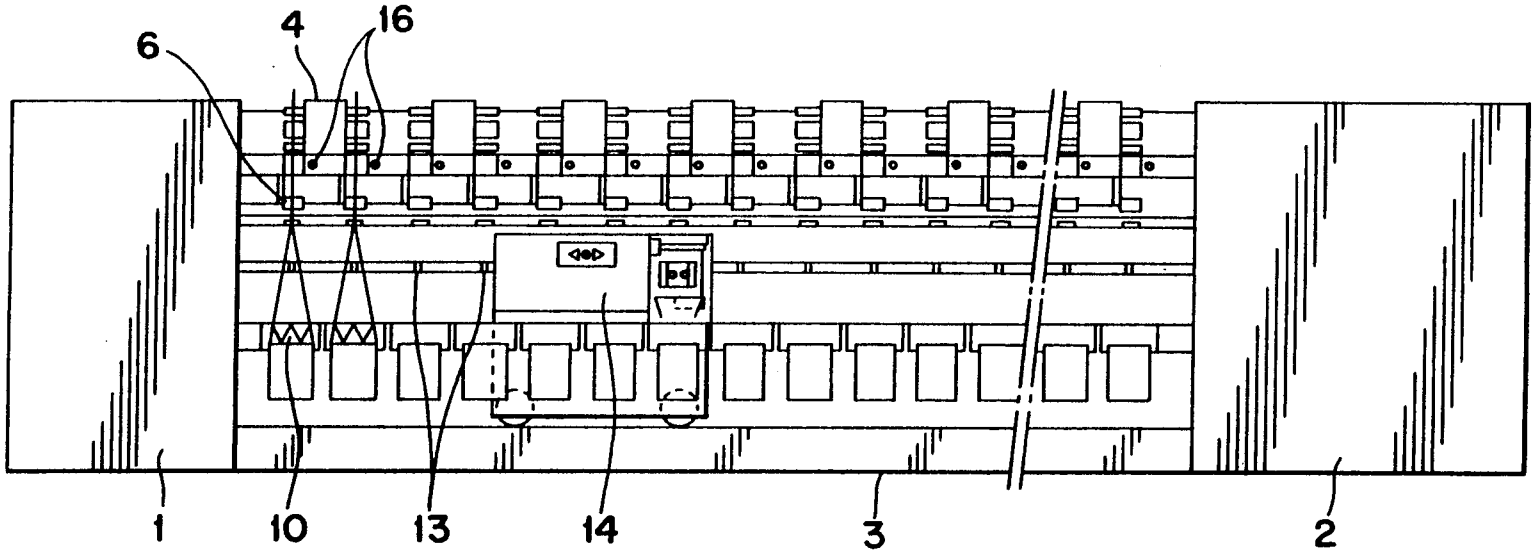
FIG. 1 is a schematic view of one embodiment of a spinning machine of the present invention.
Figure 2:
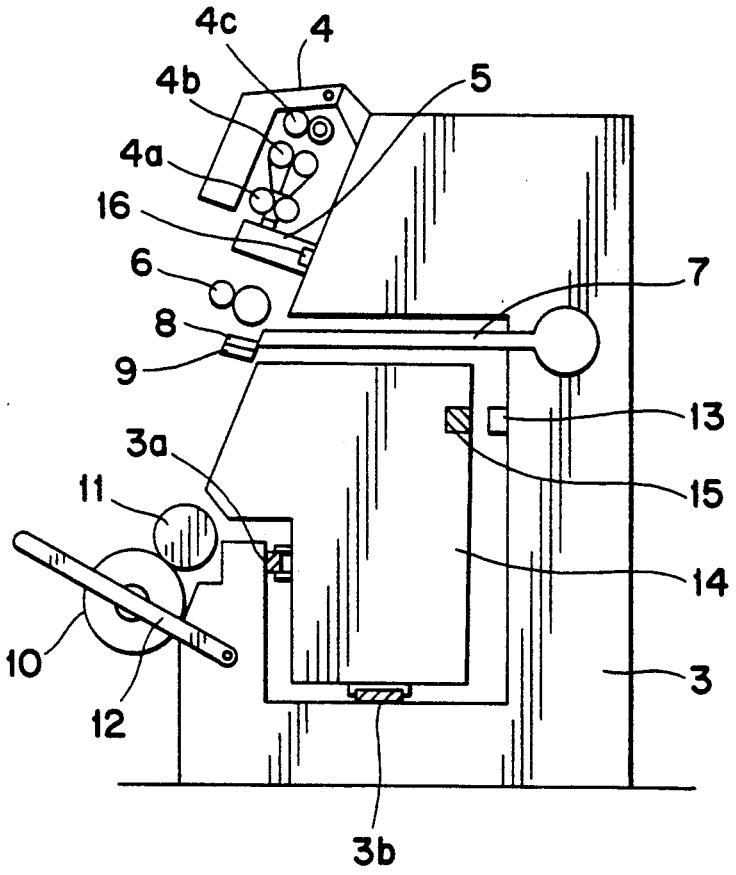
FIG. 2 is a schematic cross-sectional side view of the spinning machine shown in FIG. 1.

FIG. 1 shows one embodiment of a spinning machine of the present invention.

As shown, a spinning machine of the present invention includes a gear end 1, an out end 2, and a frame 3 therebetween.

In the machine, a drafting device 4 is provided to draft a sliver, which drafting device 4 includes front rollers 4*a*, second rollers 4*b*, and back rollers 4*c*, each including a pair of nip rollers.

The back rollers 4*c* are provided with a rotation stopping mechanism.

Reference numeral 5 denotes a yarn forming and winding device provided close to the front roller 4*a* in the drafting device 4. The device includes a suction means and a false twisting means to produce a fasciated spun yarn from a sliver. Reference numeral 6 denotes a delivery roller provided beneath the yarn forming and winding device 10. It includes a driving roller and a nip roller with a length shorter than that of the driving roller and transfers the fasciated spun yarn spun out from the yarn forming and winding device 10 to a predetermined portion with a predetermined speed.

Reference numeral 7 denotes a yarn storing device provided close to an under portion of the delivery roller 6. The device has a generally flat cross-sectional configuration and a longitudinal axis formed in a vertical direction. One end faces a yarn running pass at a right angle to the pass, while another end is connected to a negative pressure source, not shown.

Reference numeral 8 denotes a yarn detecting device provided on a portion beneath a yarn sucking aperture of the yarn storing device 7. The device detects yarn defects and/or whether yarn exists in the yarn pass or not.

The yarn detecting device of the present embodiment is further integratedly provided with a yarn cutter 9.

Reference numeral 10 denotes a yarn winding device provided under the yarn storing device 7. A plurality of yarn winding devices area arranged along the machine frame at predetermined distances therebetween.

The yarn winding device 10 includes a driving drum 11 having a groove on a surface thereof, for traversing a yarn to be wound on a bobbin, and a cradle 12 to which a yarn bobbin is rotatably contacted and which enables the bobbin to contact the surface of the driving drum 11 with a predetermined surface pressure to wind the spun yarn delivered from the delivery roller 6 on the yarn bobbin.

A spindle of the present invention includes the drafting mechanism 4, the delivery roller 6, the yarn storing device 7, and the yarn winding device 10 as mentioned above. A plurality of the spindles are arranged along a longitudinal direction of the frame 3 of the spinning machine at predetermined distance therebetween.

Reference numeral 13 denotes a detecting device for detecting an existence of the yarn treating carrier consisting, for example, of a lead switch and provided on a portion on the frame 3 opposite to a moving pass of the yarn treating carrier 14 and between the yarn storing device 7 and the yarn winding device 10 which are vertically arranged at each one of the spindles.

The detecting device 13 is operated by an operational device 15, for example, a magnet, provided on the yarn treating carrier 14 to detect a position of the carrier 14.

Reference numeral 16 denotes a operation switch provided on an operational side of the frame 3 to transmit a switching signal indicating a manual operation going on or a signal indicating that trouble has occurred on yarn already treated, to sequencer 21 provided in a control device.

Note that the operation switch 16 is provided at each one of the spindles.

Figure 5:
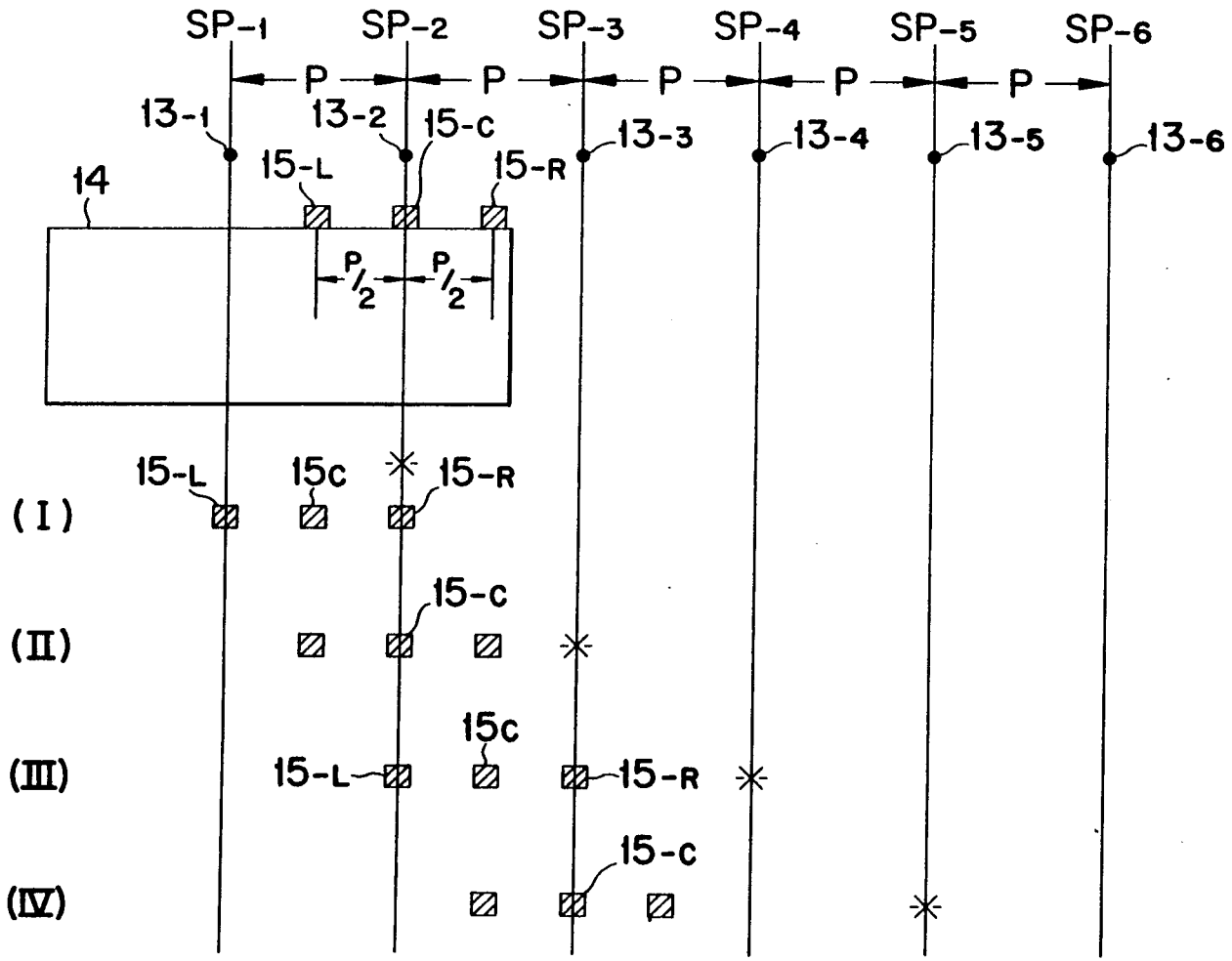
FIG. 5 is a schematic diagram of a relationship between a detecting device for detecting a position of a yarn treating carrier and a operational device operated in response to the detecting device.

As shown in FIG. 5, at least three operational devices 15 as mentioned above are successively arranged on the same line formed on a vertical side surface of the yarn treating carrier 14 opposite to the detecting device 13 provided on the machine frame 3.

These three operational devices 15 are arranged at intervals of half of the pitch P ($\frac{1}{2}$ P) between spindles. When the center device is at a center position C of a spindle for which the yarn piecing operation and the bobbin doffing operation is carried out, the other operational devices are at a right hand position R of the center position C and a left hand position L thereof respectively.

As explained above, the yarn treating carrier 14 moves along rails 3*a* and 3*b* provided on or in front of the frame 3 in a longitudinal direction of the frame 3 to carry out the yarn piecing operation and the yarn package doffing operation.

In this operation, the yarn treating carrier may perform any one of the two operations as mentioned above.

The yarn treating carrier 14 can move forward, stop, and move backward by a motor 18 with a brake mechanism, driven by an inverter 17 through a driving force transmitting mechanism 20 comprising a cogged pulley and a cogged belt, for transmit a rotating force of the motor 18 to the wheel 19 of the carrier 14.

One sequencer 21 is provided for every unit group of the spindles, 12 spindles, for example included in each group. The output thereof connects to the yarn detecting device 8, the rotation stopping mechanism of the back-roller 4*c*, the cutter 9, the yarn treating carrier detecting device 13, and the operation switch 16.

These sequencers 21-1, 21-2, . . . 21-n are connected to each other with a data-link to which a main sequencer 22 is connected as a host controller.

The main sequencer 22 outputs control signals to the inverter 17 through a cable 23 in response to the signals output from each one of sequencers.

When a yarn defect such as a slub appears on a spun yarn on a certain spindle, for example, on a spindle SP-1, while the yarn spinning and winding operation is carried out on the spinning machine, the yarn detecting device 8 is actuated to output a single indicating a yarn defect to the sequencer SEQ 21-1.

Then, the rotation stopping mechanism is actuated to stop a rotation of the back-roller 4*c*, causing stopping of the delivery of a silver and actuating the cutter 9 to cut the spun yarn.

At the same time, the yarn detecting device 8 transmits a yarn piecing operation signal for the spindle SP-1 to the main sequencer 22 through the data-link of the sequencer 21-1.

The sequencer 22 is also provided with counters for each spindle.

An initial value of each one of the counters is previously set at a value representing a full bobbin condition. The initial value is subtracted by a value representing a yarn length calculated by a yarn speed corresponding to a yarn spinning speed multiplied by a time during which a yarn existing signal is input to the counter.

When the counter value comes to zero, a full bobbin signal is output from the counter to the sequencer 21-1 through the data-link.

Thus, the sequencer 21-1 outputs an operational signal to a cutter 9 of the predetermined spindle SP-1 to actuate it, causing cutting of the spun yarn and simultaneously outputting an operational signal to the rotation stopping mechanism to stop the rotation of the back roller 4*c*.

These operational signals are stored in a data table as shown in FIG. 4 provided in each one of sequencers 21.

In the table, 0 denotes a condition in which the yarn detector or the like is inactuated (i.e., the detector does not output the yarn treatment signal), while 1 denotes a condition in which the yarn detector or the like is actuated (i.e., the detector outputs the yarn treatment signal).

Accordingly, the sequencer 21 outputs control signals to the yarn treating carrier 14 with respect to this data table, indicating, for example, acceleration, deceleration, a yarn piecing operation, a yarn bobbin doffing operation, a moving direction, and or the like.

The main sequencer 22 stores data, for example, an accelerating speed of the yarn treating carrier 14, at its starting time, a maximum moving speed thereof, and the like in a suitable memory provided therein.

Figure 3:
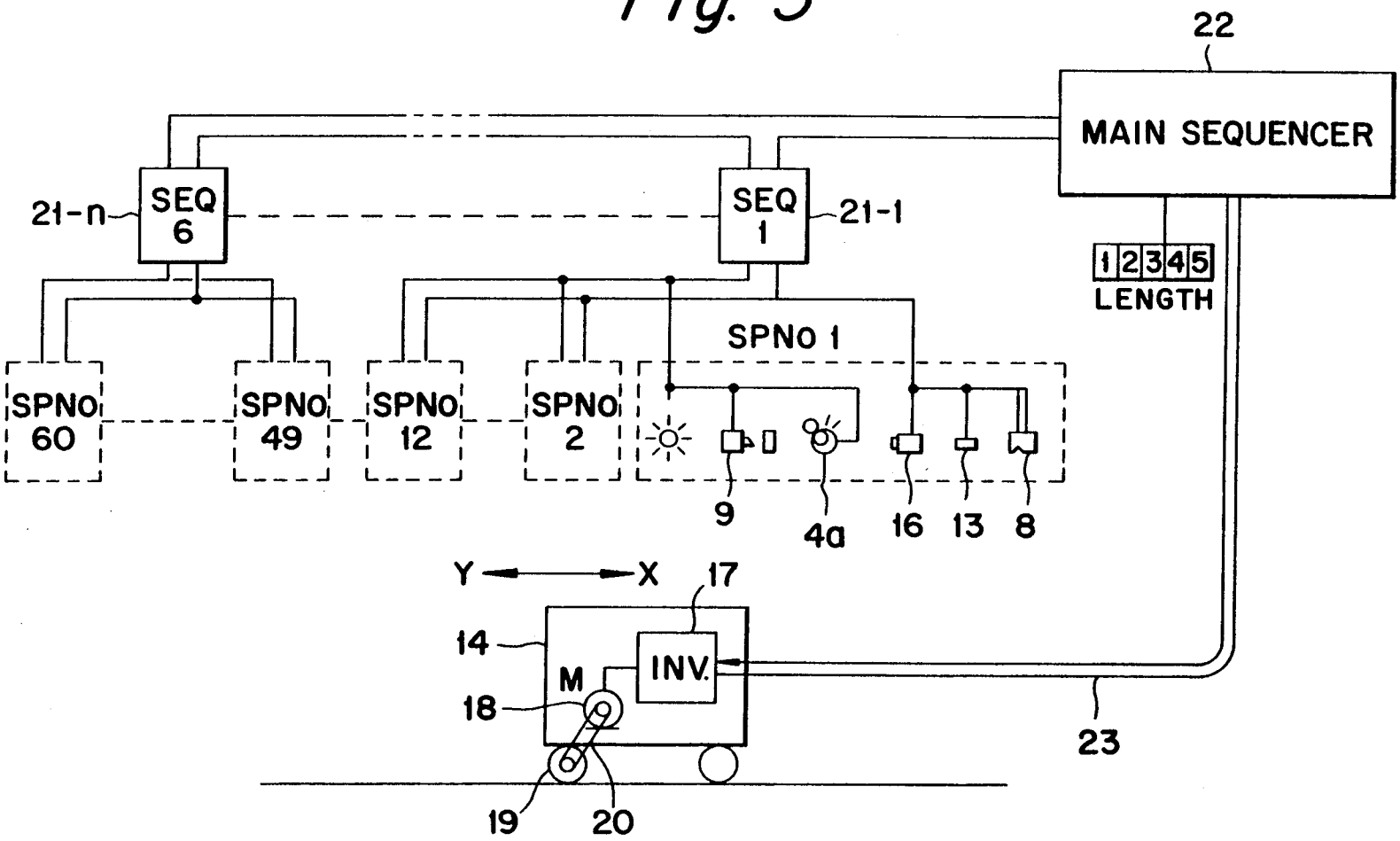
FIG. 3 is a block diagram of a control system of a spinning machine of the present invention.

The relationship between the yarn treating carrier detecting device 13 mounted on each one of the spindles and the operating device 15 is shown in FIG. 3.

In that, supposing that a pitch P between the adjacent spindles is set at 230 mm, the three operating devices 15-L, 15-C, and 15-R are provided successively with a space of 115 mm interposed therebetween on a side surface of the yarn treating carrier 14.

Note that the center of the operating device 15-C works as a center position C when the yarn piecing and bobbin doffing operations are carried out.

Therefore, when the yarn treating carrier 14 moves along the machine frame 3 and comes to a first condition (I) as shown in FIG. 5, in which the center of the operating device 15-C reaches a position 115 mm before the center position of a spindle SP-2, the yarn treating carrier detecting device 13-2 is actuated by the operating device 15-R while the yarn treating carrier detecting device 13-1 is actuated by the operating device 15-L.

Thereafter, the yarn treating carrier 14 continuously moves and comes to the second condition (II) as shown in FIG. 5, in which the center of the operating device 15-C reaches at a position just in front of the spindle SP-2, where the yarn treating carrier detecting device 13-2 is actuated by the operating device 15-C. The other yarn treating carrier detecting device 13-1 and 13-3 provided on the spindles SP-1 and SP-3, respectively, remain in an inactive condition.

On the other hand, when the yarn treating carrier 14 moves from the spindle SP-1 to the spindle SP-2, if the moving speed thereof is accelerated linearly, a decelerating signal is output from the main sequencer 22 and is input to the inverter 17 when the operating device 15-R reaches the position just in front of the spindle SP-2.

The accelerating condition is continued in the first half of the pitch length P, i.e., 115 mm, while the decelerating condition is continued in the second half of the pitch P, i.e., 115 mm.

Figure 6:
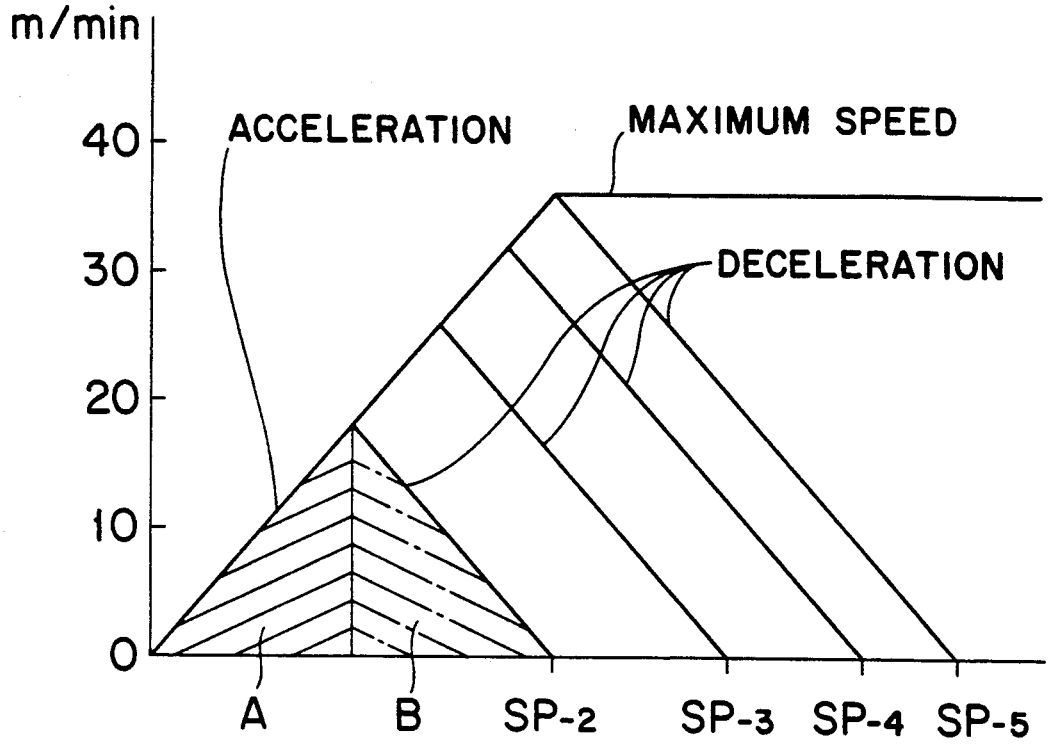
FIG. 6 is a schematic view of an accelerating condition and decelerating condition of the yarn treating carrier.

This condition is shown in FIG. 6 in which an integrated area A indicated by solid lines which represents an accelerating condition is the same as another integrated area B indicated by dotted lines which represents a decelerating condition.

Figure 7:
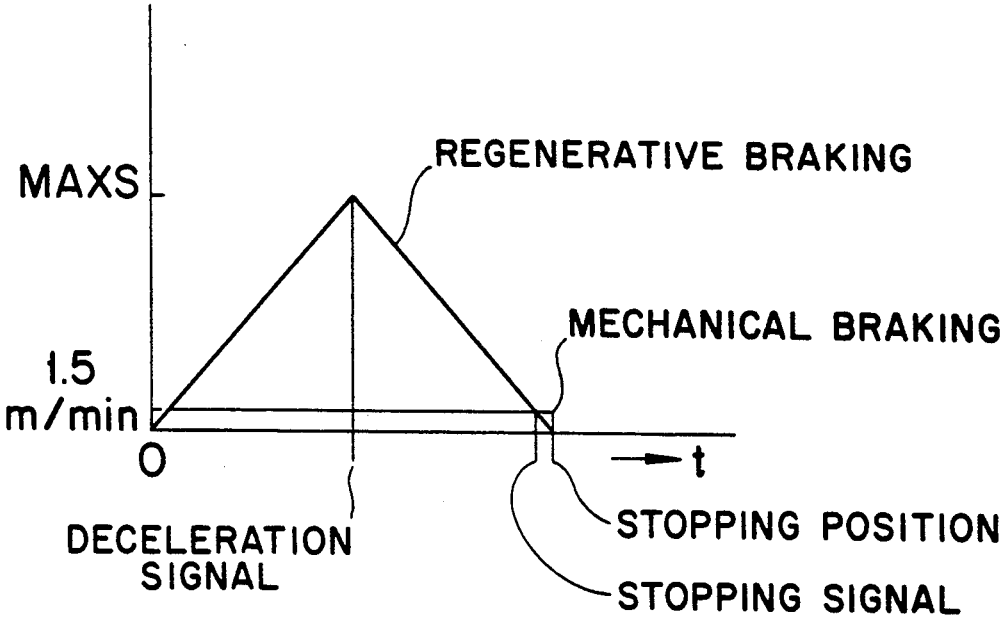
FIG. 7 is a schematic view of a time chart when the yarn treating carrier is decelerated.

In the decelerating operation of the present invention, as shown in FIG. 7, the speed of the yarn treating carrier 14 is decelerate from the maximum speed MAXS to a speed of 1.5 m/min utilizing a regenerative braking method.

After that, when the operating device 15-C of the yarn treating carrier 14, which is the center position for the yarn piecing and bobbin doffing operations, reaches a position just in front of the spindle SP-2, the yarn treating carrier 14 is stopped at the position utilizing a DC brake or another mechanical brake.

In this system, assuming that the accelerating speed and the decelerating speed an equal and the low speed of, for example, 1.5 m/min, used in the last part of this system is ignored, when the yarn treating carrier 14 moves from one spindle SP-1 to the next spindle SP-2, it is accelerated for 0.75 second to reach the maximum speed of 18.4 m/min and when the speed thereof reaches at the maximum value, it is started to be decelerated and stops after 0.75 second has passed.

On the other hand, when the yarn treating carrier 14 moves by 2 pitches, i.e., moves from the spindle SP-1 to the spindle SP-3, since the moving distance thereof is 460 mm, only when the yarn treating carrier detecting device 13-2 of the spindle SP-2 existing at an intermediate position between two spindles SP-1 and SP-3 is actuated by the operating device 15-C of the yarn treating carrier 14 is the decelerating signal output from the main sequencer 22 to the inverter 17 causing the yarn treating carrier 14 to start to be decelerated.

At this time, the yarn treating carrier 14 is located at a position 230 mm before the target spindle SP-3, and the moving speed thereof is 26 m/min, since the accelerating speed thereof is the same as the previous embodiment.

Moreover, when the yarn treating carrier 14 further moves by 3 pitches, i.e., moves from the spindle SP-1 to the spindle SP-4, the decelerating operation may be started from the center position of total pitches, i.e., total length between the spindle SP-1 and the spindle SP-4.

In this case, the decelerating signal is output from the main sequencer 22 to the inverter 17, causing the yarn treating carrier 14 to start to be decelerated, when both of the yarn treating carrier detecting device 13-2 of the spindle SP-2 and the yarn treating carrier detecting device 13-3 of the spindle SP-3 are simultaneously actuated by the operating devices 15-L and 15-R respectively.

The moving speed of the yarn treating carrier 14 in this case is 37 m/min.

Generally, when the maximum speed of the yarn treating carrier 14 is set at 37 m/min and when it moves to and stops at a spindle four (4) pitches ahead of the spindle to which a yarn treatment operation has just finished, the decelerating operation may be started when a yarn treating carrier detecting device 13 provided on a spindle located two pitches before the target spindle is actuated by an operating device mounted on the yarn treating carrier 14.

In this accelerating and decelerating operation, the operation time of the yarn treating carrier detecting device 13 is not taken into the account.

In actual operation, however, the operational width between the yarn treating carrier detecting device 13 and the operating devices 15 of the yarn treating carrier 14 is estimated to be about 30 mm taking both operational widths of the yarn treating carrier detacting device 13 and the operating devices 15 into account.

Therefore, in accordance with the relationship between the yarn treating carrier detecting device 13 and the operating device 15 of the yarn treating carrier 14 as shown in FIG. 5, the yarn treating carrier detecting device 13 is actuated at a position 15 mm before the center position of the operating devices 15.

Thus, the decelerating operation of this case will be started at a time earlier than the starting time of the decelerating operation in the above-mentioned system.

Therefore, the decelerating operation is finished at a position before the target spindle and the yarn treating carrier 14 can move at a low speed of 1.5 m/min for the rest of distance.

In this case, a stopping signal is output from the main sequencer 22 simultaneously with the actuation of the yarn treating carrier detecting device 13 to actuate the braking mechanism, so the yarn treating carrier 14 can be stopped at the predetermined position precisely.

In order to improve the accuracy of the stopping operation, a device for detecting a stopping position of the yarn treating carrier 14 may be provided, whereby the mechanical braking system may be actuated by a signal output from the stopping position detecting device, or the yarn treating carrier 14 may be stopped by contacting a stopper pin, a dog, or the like provided on the spinning frame 3.

An operation for changing a moving direction of the yarn treating carrier 14 will be explained hereunder.

When a yarn defect, for example, a slub, is detected by the yarn detecting device 8 of the spindle SP-1, the device outputs a yarn piecing operation signal for the spindle SP-1 to the main sequencer 22 through the data-link of the sequencer 21-1.

Then, all of data stored in the data table provided in the main sequencer 22 as shown in FIG. 4 is scanned to check whether there is a spindle from which the yarn treatment signal is output taking into account the position at which the yarn treating carrier 14 currently exists and a moving direction thereof.

When all spindles existing in an advance direction of the yarn treating carrier 14, i.e., a first direction X, output a signal of zero (0) representing the condition in which no yarn treatment signal is output, but one or more spindle existing in a reverse direction thereof, i.e., a first direction Y, outputs a signal of one (1) representing the condition in which yarn treatment requiring signal is output, the main sequencer 22 immediately outputs a decelerating signal to the inverter 17 to decelerate the yarn treating carrier 14 utilizing the regenerative braking system and then outputs a stopping signal thereto to completely stop the yarn treating carrier 14 utilizing the mechanical braking system.

Successively, the main sequencer 22 outputs a moving signal for moving the yarn treating carrier 14 in a reverse direction, i.e., a second direction Y, to the first direction X, to the inverter 17 to accelerate it and move to a new target spindle from which the yarn treating operation a signal is output.

Then, the same decelerating and stopping operations as explained above are carried out to stop the yarn treating carrier 14 at the spindle from which the yarn treating operation signal is output.

On the other hand, when a plurality of spindles requiring a yarn treating operation are detected, the counter values representing amounts of yarn wound on the packages, processed and stored in the memory of the data table in the main sequencer 22 in the same manner as explained above are used and compared.

Then, the spindle having the largest counter value is preferentially selected. The signals including a moving direction signal, an accelerating signal, a decelerating signal and a stopping signal are output from the main sequencer 22 to the inverter enabling the yarn treating carrier 14 to move to and stop at the spindle thus selected.

Note that a spindle having a large counter value has a yarn bobbin of a small yarn package diameter, while a spindle having a small counter value has a yarn bobbin of a large yarn package diameter.

According to the present invention, as mentioned above, the spinning machine includes a yarn treating carrier provided with a yarn piecing mechanism and a yarn package doffing mechanism therein, moving along a rail provided on a frame of a spinning machine so as at least to stop at a predetermined spindle for carrying out a yarn piecing operation and a yarn package doffing operation, and a detecting means for detecting a position of the yarn treating carrier at each spindle portion, the yarn treating carrier controlled so as to perform at least one of a moving operation, a decelerating operation, and a stopping operation in response to a yarn treatment signal and a detection signal of a position of the yarn treating carrier, each of which being output from each of the spindles. Therefore, a detecting device for detecting a yarn treatment requiring signal can be commonly used, and a position of a yarn treating carrier can be detected precisely. Moreover, the amount of information to be transmitted between a yarn treating carrier and a machine frame can be reduced.

According to another aspect of the present invention, since a starting position at which a speed of the yarn treating carrier is decelerated is varied in response to a current moving speed of the yarn treating carrier with respect to the yarn treatment signal output from each of the spindles, a position in which the yarn treating carrier exists, and a distance by which the yarn treating carrier moves, a moving speed of the yarn treating carrier can be increased.

According to the third aspect of the present invention, since the yarn treating carrier is controlled so as to perform at least one of a moving operation, a stopping operation, and reverse moving operation in response to a position signal indicating a spindle position at which a yarn treatment is required and output from each of the spindles, a position signal indicating a position at which the yarn treating carrier exists at the time when the yarn treatment is required, and information of a moving direction of the yarn treating carrier, the operating pattern of the yarn treating carrier including a moving direction thereof can be easily changed even if it is moving in one direction.

According to the last aspect of the present invention, an amount of yarn wound on a yarn bobbin is counted from the time when a yarn winding operation is started, and the yarn treating carrier is controlled so that the yarn treating carrier is preferentially moved to a spindle with a yarn package of a yarn amount is smaller than that of other spindles when a plurality of spindles simultaneously require the yarn treatment operation, so the variation of the amount of yarn wound on the yarn packages, i.e., the diameter of the yarn packages, can be reduced.

We claim:

1. A spinning machine provided with a plurality of spinning spindles and having a yarn treating carrier provided with a yarn piecing mechanism and a yarn package doffing mechanism therein, movable along a rail provided on a frame of a spinning machine so as at least to stop at a predetermined spindle for carrying out a yarn piecing operation and a yarn package doffing operation, wherein each of said spindles has a yarn treating carrier detecting means for detecting a position of said yarn treating carrier at each spindle portion, and at least three operational device means each for determining a current position of said yarn treating carrier and operationally connected through said yarn treating carrier detecting means to determine a direction of movement of said yarn treating carrier with respect to said detecting means, said three operational device means being disposed in series on a side surface of said yarn treating carrier opposite to a row of the detecting means on the spinning frame whereby said yarn treating carrier is controlled so as to perform at least one of a forward moving operation, a decelerating operation, and a stopping operation in response to a yarn treatment signal and a detection signal of a position of said yarn treating carrier, each of which being output from each of said spindles.

2. A spinning machine according to claim 1, wherein a starting position at which a speed of said yarn treating carrier is decelerated is varied in response to a current moving speed of said yarn treating carrier with respect to said yarn treatment signal output from each of said spindles, a position in which said yarn treating carrier exists, and a distance by which said yarn treating carrier moves.

3. A spinning machine according to claim 1, wherein said yarn treating carrier is further controlled so as to perform a reverse direction moving operation in response to a position signal indicating a spindle position at which a yarn treatment is required and output from each of said spindles, a position signal indicating a position at which said yarn treating carrier exists at the time when said yarn treatment is required, and information of a moving direction of said yarn treating carrier.

4. A spinning machine according to claim 1, wherein an amount of yarn wound on a yarn bobbin is counted from the time when a yarn winding operation is started, and said yarn treating carrier is controlled so that it is preferentially moved to a spindle with a yarn package of a yarn amount smaller than that of other spindles when a plurality of spindles simultaneously require said yarn treatment operation.

* * * * *